United States Patent [19]

Umehara et al.

[11] Patent Number: 4,779,737

[45] Date of Patent: Oct. 25, 1988

[54] DIVISIBLE PACKAGE BOX

[75] Inventors: Akiyoshi Umehara, Chiba; Shintaro Ohashi, Kanagawa; Seiji Naruse, Chiba, all of Japan

[73] Assignee: Lion Corporation, Japan

[21] Appl. No.: 10,893

[22] Filed: Feb. 4, 1987

[30] Foreign Application Priority Data

Feb. 10, 1986 [JP] Japan ..... 61-17959[U]

[51] Int. Cl.[4] ..... B65D 5/18

[52] U.S. Cl. ..... 206/602; 229/23 R; 229/120.03; 229/120.24; 229/143

[58] Field of Search ..... 229/15, 27, 28 R, 23 R, 229/143, 120.03, 120.24, 120.37; 206/602

[56] References Cited

U.S. PATENT DOCUMENTS

| | | | |
|---|---|---|---|
| 2,690,285 | 9/1954 | Main | 229/15 |
| 2,710,130 | 6/1955 | Grecco | 229/28 R |
| 2,718,998 | 9/1955 | Bemiss | 229/195 |
| 2,737,334 | 3/1956 | Halgren | 229/15 |
| 3,348,667 | 10/1967 | Beeby | 229/15 |
| 3,412,920 | 11/1968 | Desforges | 229/15 |
| 3,704,823 | 12/1972 | Howe | 229/143 |
| 4,282,999 | 8/1981 | Moen | 229/15 |
| 4,362,264 | 12/1982 | Duncan | 229/27 |
| 4,487,319 | 12/1984 | Barrash | 229/15 |

FOREIGN PATENT DOCUMENTS

| | | | |
|---|---|---|---|
| 40075 | 11/1965 | German Democratic Rep. | 229/27 |
| 57-159635 | 10/1982 | Japan . | |

*Primary Examiner*—Stephen Marcus
*Assistant Examiner*—Gary E. Elkins
*Attorney, Agent, or Firm*—Steinberg & Raskin

[57] ABSTRACT

A divisible package box comprising a main sheet and a partition body, the main sheet including a bottom, two side and two cover sections, flaps and a cutting line such as a cutting tape or a perforated line across the bottom section and the bottom flaps, the partition body consisting of two partition members in back to back contact with each other, each partition member including a partition section and two end sections at its ends, the sections and the flaps being defined by score lines for folding therearound. The end sections and the side flaps constitute end faces of an assembled package box so that the inner surfaces of all faces thereof may be completely flat. The assembled package box may be divided into two small boxes along the cutting line and the partition sections which constitute each end face of the divided two small boxes.

15 Claims, 4 Drawing Sheets

DIVISIBLE PACKAGE BOX

BACKGROUND OF THE INVENTION

The present invention relates to an improved divisible package box and more particularly to a divisible package box of a cube or rectangular parallelepiped, which is made of a sheet of cardboard, strawboard, or corrugated cardboard and which is divisible into at least two small boxes.

A variety of package boxes of a rectangular solid, which are made of cardboard, strawboard or corrugated cardboard, have been developed for containing and carrying various goods or small commodities. By using such package boxes, the goods may be not only protected but also carried and stored conveniently and rationally. The size of the package box is suitably determined depending on the sizes and kinds of the goods to be contained therein and carrying efficiency thereof. When the package box is too small, many hands are required for carrying and storing the goods therein, and thus the distribution cost is increased.

However, when a number of the same goods are contained within a large package box, the number of the goods per one lot is preferably reduced at the end of the distribution process, and accordingly the size of the box may be preferably smaller. Therefore, generally the goods are contained in small boxes and then a plurality of these small boxes are contained in a large box. At the retail store, the small boxes are taken out of the large box, and the small boxes are sold to the end user. In this case, two kinds of package boxes are required, with the result of increased packaging costs.

In order to overcome the aforementioned disadvantages of the conventional packing method, a divisible package box which is divisible into two small boxes as occasion demands, each divided small box having the overall functions of a package box, is disclosed in the Japanese Utility Model Laying-Open Specification No. 57-159635.

FIG. 7 shows an embodiment of such a divisible package box.

In this case, the divisible package box comprises a sheet member including a bottom section 1, a pair of side sections 2 integrally connected to the opposite sides of the bottom section 1, a pair of cover sections 3 integrally connected to the outer sides of the side sections 2, and pairs of connecting flaps 5 integrally connected to the opposite ends of the bottom section 1 and the side sections 2, these sections 1–3 and flaps 5 being defined by respective fold or score lines for folding therearound, a pair of end section members 8, each having connecting flaps 12 at its opposite sides, the end section members 8 and the flaps 12 being defined by fold or score lines for folding therearound, and a pair of partition section members 9 of the same size as the end section members 8, each having connecting flaps 13 at its opposite sides, the partition section member 9 and the flaps 13 being defined by fold or score lines for folding therearound. The sheet member, the end section members 8 and the partition section members 9 are made of a sheet of cardboard, strawboard, corrugated cardboard, plastic board or the like. The side sections 2 of the sheet member are perpendicularly bent inwards and the cover sections 3 are bent outward. The flaps 5 of the bottom section 1 and the side sections 2 are perpendicularly bent inwards. Then, the end section members 8 having the perpendicularly bent flaps 12 are attached to the opposite ends of the bottom section 1 and the side sections 2 by sticking the flaps 12 onto the side sections 2 via adhesive and sticking the flaps 5 onto the outer surfaces of the end section members 8 via adhesive, thereby forming a package box. The partition section members 9 having the perpendicularly bent flaps 13 are in back to back contact with each other and the contacted partition section members 9 are mounted in the center of the package box parallel with the end section members 8 so as to separate its inside space into two parts by sticking the flaps 13 onto the side sections 2 via adhesive. The assembled box is provided with a cutting tape 6 across the central portions of the bottom section 1, the side sections 2 and the cover sections 3 therethrough along the partition section members 9. A pair of notches 7 are formed on the cutting tape 6 of the free end portions of the cover section 3.

As shown in FIG. 8, the assembled package box is divided into two small boxes by cutting the bottom section 1, the side section 2 and the cover sections 3 along the cutting tape 6 from the notches 7, and each of the partition section members 9 constitute one end wall of the divided small boxes. Therefore, the disadvantages of the double packed package boxes of the prior art can be overcome.

However, in this case, the assembled divisible package box has the projecting portions of the connecting flaps 12 and 13 on its inner surface. Accordingly, if a shock or vibration is given to the divisible package box containing a plurality of glass bottles, each contained within a carton, while it is being carried, the projecting portions of the flaps often damage the cartons. In addition, goods such as bottles, depending on their shape, may not stay properly arranged in line due to the projecting portions of the flaps. Further, on manufacturing the package box, there is an increase in the number of components and thus a decrease in manufacturing efficiency. Also, as there is an increase in the number of connecting flaps, there is an increase in the cost of the material.

SUMMARY OF THE INVENTION

Accordingly, it is an object of the present invention to provide an improved divisible package box, free from the aforementioned defects and disadvantages of the prior art, with an inside surface which is completely flat, thus resulting in a package which can be manufactured economically due to the saving of material.

In accordance with one aspect of the invention, there is provided a divisible package box comprising a main sheet including a bottom section, a pair of side sections integrally connected to the opposite sides of the bottom section, and a pair of cover sections integrally connected to the outer sides of the side sections; the bottom section, the side sections and the cover sections connected in series constituting a respective bottom face, side faces and top face of an assembled package box, parallel first score lines defining the contact side edges of the bottom section, the side sections and the cover sections for folding therearound, a pair of bottom flaps integrally connected to the opposite ends of the bottom section, two pairs of side flaps integrally connected to the opposite ends of the side sections, and two pairs of cover flaps integrally connected to the opposite ends of the cover sections, second score lines defining the contact end edges of the bottom flaps, the side flaps, the cover flaps, the bottom section, the side sections and the cover sections for folding therearound, the second score lines substantially extending along a pair of parallel straight lines perpendicular to the first score lines, and a cutting line across the central portions of the bottom section and the bottom flaps in parallel with the first score lines, and a partition body having an H-shaped transverse cross section, consisting of a pair of partition members having a C-shaped transverse cross section, each partition member including a partition section and a pair of end sections integrally connected to the opposite ends of the partition section, and third score lines defining the contact end edges of the partition section and the end sections for folding therearound, the two partition members being in back to back contact with each other at their partition section, the partition body being disposed onto the bottom section of the main sheet by putting the lower ends of the partition sections of the partition members along the cutting line of the bottom section, the side sections being perpendicularly bent so that the free ends of the side flaps may be abutted against the free ends of the end sections of the partition members, and thereby the side flaps and the end sections constitute the end faces of the assembled package box, the cover sections being perpendicularly bent onto the upper ends of the partition members, and the bottom flaps and the cover flaps being perpendicularly bent onto the outer surfaces of the end sections and the side flaps, thereby forming the assembled package box so as to be divisible into two along the cutting line of the bottom section and the bottom flaps of the main sheet.

In a preferred embodiment of the invention, the width of the partition section of the partition member is substantially the same as the width of the bottom section of the main sheet, and the width of the side section of the main sheet is substantially the same as the height of the partition member as well as the length of the end section of the partition member and the width of the side flap of the main sheet is substantially the same as half the length of the bottom section of the main sheet.

In another preferred embodiment of the invention, each end of the bottom section and the cover sections extends frontwards or rearwards longer than that of the side sections by a length corresponding to the thickness of the main sheet.

BRIEF DESCRIPTION OF THE DRAWINGS

Other and further objects, features and advantages of the invention will appear more fully from the following description with reference to the preferred embodiment thereof taken in conjunction with the accompanying drawings, in which.

DESCRIPTION OF THE PREFERRED EMBODIMENT

Figure 1:
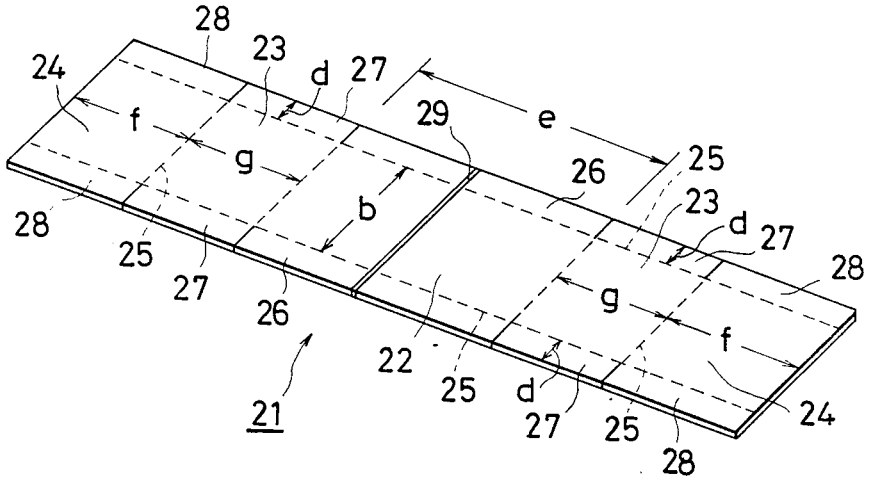
FIG. 1 is a perspective view of a main sheet of a divisible package box according to the present invention.

Referring now to the drawings, wherein like reference numerals designate similar or corresponding components throughout the different figures, there is shown in FIGS. 1–6 a divisible package box according to the present invention.

In FIG. 1, there is shown a main sheet 21 for assembling the divisible package box according to the present invention. The main sheet 21 has a plate form and is made of cardboard, strawboard, corrugated cardboard, plastic board or the like. The main sheet 21 comprises a bottom section 22, a pair of side sections 23 integrally connected to the opposite sides of the bottom section 22, and a pair of cover sections 24 integrally connected to the outer sides of the side sections 23, and the contact side edges of the bottom section 22, the side sections 23 and the cover sections 24 are defined by parallel fold or score lines 25 for folding therearound. A pair of bottom flaps 26 are integrally connected to the opposite ends of the bottom section 22, and two pairs of side flaps 27 are integrally connected to the opposite ends of the side sections 23. Two pairs of cover flaps 28 are integrally connected to the opposite ends of the cover sections 24. The contact end edges of the bottom flaps 26, the side flaps 27, the cover flaps 28, the bottom section 22, the side sections 23 and the cover sections 24 are defined by parallel fold or score lines 25 for folding therearound. The score lines 25 for defining the flaps extend along a pair of parallel longitudinal substantially straight lines perpendicular to the score lines 25 defining the sides of the sections. The bottom section 22 and the bottom flaps 26 are provided with a cutting line 29 such as a perforated line or a cutting tape across the central portions in parallel with the score lines 25 for defining the sides of the sections 22, 23 and 24.

Figure 2:
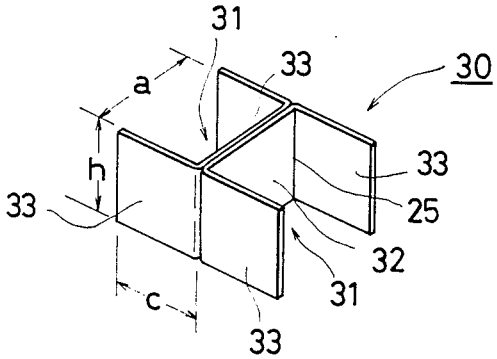
FIG. 2 is a perspective view of a partition body of the divisible package box according to the present invention.

In FIG. 2, there is shown a partition body 30 having an H-shaped transverse cross section for assembling the divisible package box according to the present invention. The partition body 30 is made of the same material as the main sheet described above. The partition body 30 consists of a pair of partition members 31 having a C-shaped transverse cross section, and the partition members 31 are in back to back contact with each other at their central portions. The two partition members 31 may be joined to each other by using an adhesive so that they will be readily detachable. Ecch partition member 31 comprises a partition section 32 and a pair of end sections 33 integrally connected to the opposite ends of each of the partition sections 32, and the contact end edges of the partition sections 32 and the end sections 33 are defined by parallel fold or score lines 25 for folding therearound. The end sections 33 are perpendicularly connected to the opposite ends of the partition sections 32 via score lines 25.

In this embodiment, the width a of the partition sections 32 of the partition members 31 is substantially the same as the width b of the bottom section 22 of the main sheet 21, and the length c of the end sections 33 of the partition members 31 and the width d of the side flaps 27 of the main sheet 21 are substantially the same as half of the length e of the bottom section 22. Further, the length f of the cover sections 24 is substantially the same as the length of the end sections 33 of the partition members 31 and the width d of the side flaps 27 of the main sheet 21, i.e., half of the length e of the bottom section 22. The height h of the partition members 31 or the partition body 30 is substantially the same as the length g of the side sections 23.

In practice, each end of the bottom section and the cover sections extends frontwards or rearwards longer than that of the side sections by a length corresponding to the thickness of the main sheet.

The operation for assembling the divisible package box according to the present invention from the main sheet 21 and the partition body 30 will now be described with reference to FIGS. 3–5.

Figure 3:
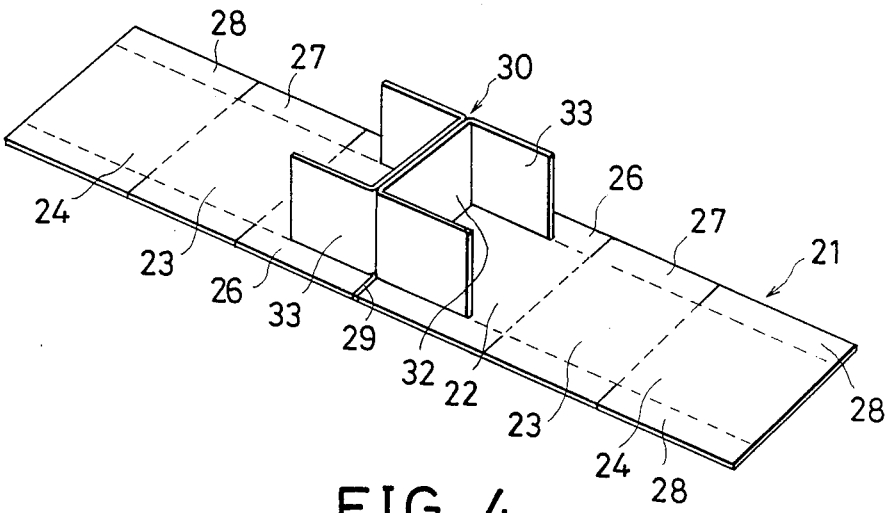
FIGS. 3–5 are perspective views for showing the process for assembling the divisible package box from the main sheet of FIG. 1 and the partition body of FIG. 2.

As shown in FIG. 3, the partition body 30 is disposed onto the bottom section 22 of the main sheet 21 by putting the lower ends of the partition sections 32 of the partition members 31 along the cutting line 29 of the bottom section 22, and then the side sections 23 with the cover sections 24 of the main sheet 21 are perpendicularly bent inwards along the score lines 25 onto the partition body 30, thereby forming an angular cylinder form. The bottom section 22, the side sections 23 and the cover sections 24 constitute a respective bottom face, side faces and top face of an assembled package box. Then, the side flaps 27 of the side sections 23 are perpendicularly bent inwards, so that the free ends of the side flaps 27 may abut against the free ends of the end sections 33 of the partition members 31 because the width d of the side flaps 27 and the length c of the end sections 33 are substantially the same as half of the length e of the bottom section 22, and thereby the end sections 33 and the side flaps 27 together constitute the end faces of the assembled package box. Then, the bottom flaps 26 are perpendicularly bent inwards onto the outer surfaces of the end sections 33 and the side flaps 27, and these members are sealed by using adhesive or staples, thereby obtaining the assembled divisible package box, as shown in FIG. 4.

Figure 4:
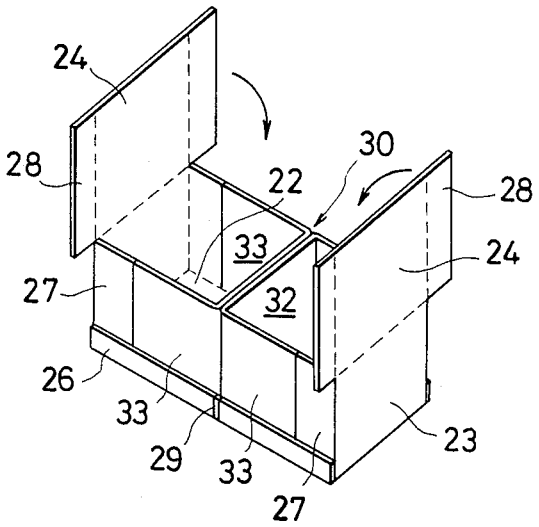

Goods or small commodities are then placed into the two spaces of the assembled package box of FIG. 4, and the cover sections 24 are perpendicularly bent onto the top end of the partition body 30. To obtain the package box as shown in FIG. 5, the cover flaps 28 are perpendicularly bent inwards onto the outer surfaces of the end sections 33 and the side flaps 27 and these members are sealed by using adhesive or staplers. The contact ends of the cover sections 24 may be sealed by adhesive tape or the like, as occasion demands, and thus the goods are stored or carried contained within the package box.

Figure 5:
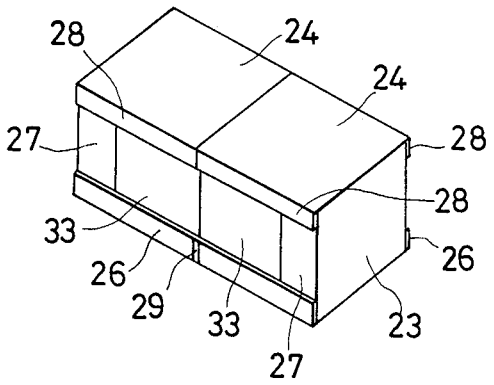
Figure 6:
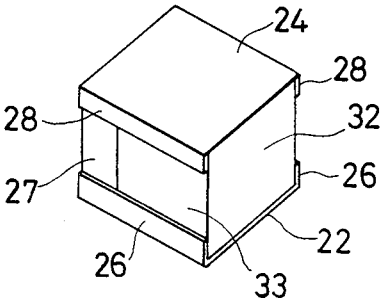
FIG. 6 is a perspective view of a divided small box of the assembled package box of FIG. 5.
Figure 7:
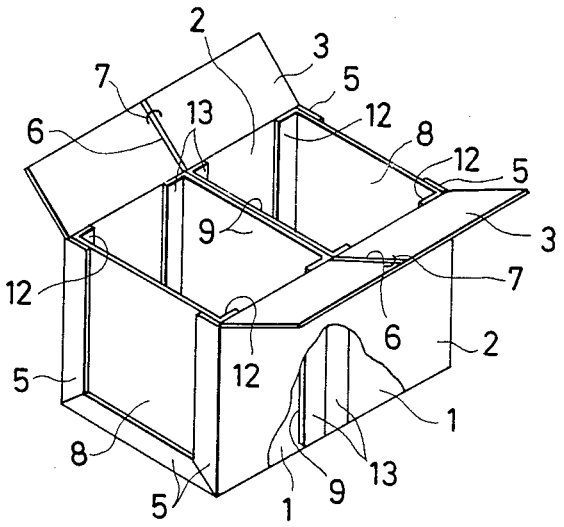
FIG. 7 PRIOR ART
FIG. 7 is a perspective view, partly in section, of a conventional divisible package box.
Figure 8:
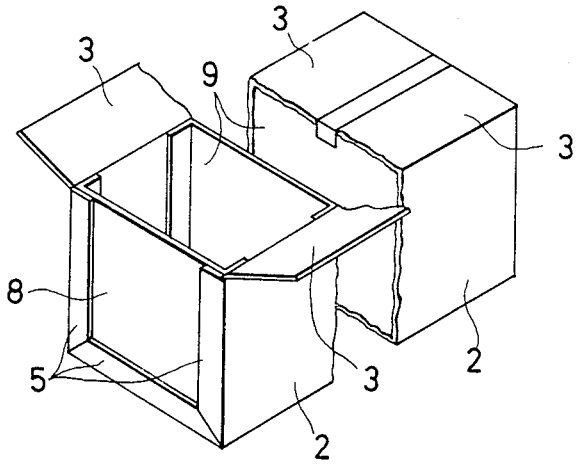
FIG. 8 PRIOR ART
FIG. 8 is a perspective view of the divided small boxes of the package box of FIG. 7.

The package box of FIG. 5 can be divided into two small boxes, if necessary, as shown in FIG. 6. That is, the package box is divided into two along the cutting line 29 of the main sheet 21 by cutting the bottom section, the side sections and the cover sections at their central portions since the two partition members 31 either do not adhere to each other or are readily detachably contacted. The partition members 31 function as one pair of the end walls of the divided small boxes and the small boxes have the same overall functions as the assembled package box.

According to the present invention, the package box is readily dividable into two small boxes at any stage of the distribution process, as occasion demands.

Since the side flaps 27 are abutted against the end sections 33, that is, they do not overlap thereon, and the bottom flaps 26 and the cover flaps 28 are attached to the outer surfaces of the side flaps 27 and the end sections 33 in the flat plane, no projecting portion exists on the inner surface of the package box. Accordingly, when the goods are contained in cartons within the package box, the cartons are not damaged by shocks or vibrations given to the package box, and thus goods will stay properly arranged in line. In addition, as the goods can be stably contained within the package box without, as said above, receiving any shock or vibration damage, such a package box is economical. Therefore, the goods can be handled conveniently and rationally during the distribution process by using the package box of the present invention. In addition, the flap portions overlaying the box members are minimized, and hence material can be saved. Further, the number of components is small, and thus the package box can be manufactured both inexpensively and with increased efficiency.

Although the present invention has been described in its preferred embodiment with reference to the accompanying drawings, it is readily understood that various changes and modifications may be made by a person skilled in the art without departing from the spirit and scope of the present invention.

For instance, the length of the package box can be enlarged and two cutting lines 29 may be formed on the bottom section and the bottom flaps in parallel with each other in the same manner as in the above described embodiment. In this case, the package box may be divided into three small boxes.

Further the partition body 30 may be made of one member, that is, the two partition members 31 may be integrally connected at the bottom ends of the partition sections 32 via a fold or score line for folding therearound or via a cutting tape or a perforated line.

Further, the shape of the assembled package box may be not only a cube and a rectangular parallelepiped but also other various solids.

What is claimed is:

1. A divisible package comprising:

a main sheet including:

a bottom section, a pair of side sections integrally connected to opposite sides of the bottom section, and a pair of cover sections integrally connected to outer sides of the side sections, the bottom section, the side sections and the cover sections connected in series constituting a respective bottom face, side faces and top face of an assembled package;

parallel first score lines defining contact side edges of the bottom section, the side sections and the cover sections for folding therearound;

a pair of bottom flaps integrally connected to opposite ends of the bottom section, two pairs of side flaps integrally connected to oppsoite ends of the side sections, and two pairs of cover flaps integrally connected to opposite ends of the cover sections;

second score lines defining contact end edges of the bottom flaps, the side flaps, the cover flaps, the bottom section, the side sections and the cover section for folding therearound, the second score lines substantially extending along a pair of parallel straight lines perpendicular to the first score lines; and a cutting line across the bottom section and the bottom flaps in parallel with the first score lines; and a partition body having an H-shaped transverse cross section, comprising a pair of partition members each having a C-shaped transverse cross section, and each partition member including:

a partition section and a pair of end sections integrally connected to opposite ends of the partition section; and third score lines defining contact end edges of the partition section and the end sections for folding therearound;

the two partition members being in back to back contact with each other at their partition sections and being severable therealong, the partition body being disposed onto the bottom section of the main sheet by putting lower ends of the partition sections of the partition members along the cutting line of the bottom section, the side sections being perpendicularly bent, the side flaps being perpendicularly bent so that free ends of the side flaps abut against the free ends of the end sections of the partition members, and thereby the side flaps and the end sections constitute end faces of the assembled package, the cover sections being perpendicularly bent onto upper ends of the partition members, and the bottom flaps and the cover flaps being perpendicularly bent onto outer surfaces of the end sections and the side flaps, thereby forming the assembled package so as to be divisible into two boxes along the cutting line of the bottom section and the bottom flaps of the main sheet.

2. A divisible package as defined in claim 1, wherein the width of each partition section of the partition member is substantially the same as the width of the bottom section of the main sheet, and the length of each end section of the partition member and the width of the side flap of the main sheet are substantially the same as half the length of the bottom section of the main sheet, and wherein the length of the side section of the main sheet is substantially the same as the height each partition member.

3. A divisible package as defined in claim 2, wherein each end of the bottom section and the cover sections extends frontwards or rearwards longer than that of the side sections by a length corresponding to the thickness of the main sheet.

4. A divisible package as defined in claim 1, wherein the assembled package is a rectangular parallelpiped.

5. A divisible package as defined in claim 1, wherein the cutting line comprises a cutting tape.

6. A divisible package as defined in claim 1, wherein the cutting line comprises a perforated line.

7. The package of claim 2, wherein the length of each cover section is substantially equal to the length of each end section of the partition member and the width of the side flap of the main sheet.

8. The package of claim 1, wherein, when assembled, said side flaps do not overlap said end sections.

9. The package of claim 8, being free of projecting portions on an inner surface thereof, when assembled.

10. The package of claim 1, additionally comprising a plurality of cutting lines across the bottom section and a plurality of partition bodies, wherein said package is divisible into a least three boxes.

11. The package of claim 1, wherein said cutting line is situated across a central portion of the said bottom section.

12. The package of claim 1, wherein said partition body is integrally formed.

13. The package of claim 1, wherein only said bottom flaps overlap said end faces of said package when assembled and open; and only said bottom and said cover flaps overlap said end faces of said package when assembled and closed.

14. The package of claim 1, wherein outer surfaces of said side sections and of said partition sections are free of projections when said package is divided.

15. The package of claim 2, wherein the width of said bottom flap is less than height of each partition member or length of the side section.

* * * * *